United States Patent [19]

Heldmann et al.

[11] Patent Number: 5,054,367

[45] Date of Patent: Oct. 8, 1991

[54] AMMUNITION POSITIONER, ESPECIALLY FOR A COMBAT VEHICLE

[75] Inventors: Heinrich Heldmann, Kassel; Erich Wallwey, Vellmar, both of Fed. Rep. of Germany

[73] Assignee: Wegmann & Co., Kassei, Fed. Rep. of Germany

[21] Appl. No.: 546,626

[22] Filed: Jun. 29, 1990

[30] Foreign Application Priority Data

Jul. 7, 1989 [DE] Fed. Rep. of Germany ..... 3922317

[51] Int. Cl.[5] ..... F41A 9/13

[52] U.S. Cl. ..... 89/46

[58] Field of Search ..... 89/45, 46, 47, 33.05, 89/33.03

[56] References Cited

U.S. PATENT DOCUMENTS

| | | | |
|---|---|---|---|
| 2,474,975 | 7/1949 | Goodhue | 89/46 |
| 3,249,011 | 5/1966 | Wermager et al. | 89/45 |
| 3,763,741 | 10/1973 | Rieke | 89/47 |
| 4,318,311 | 3/1982 | Echtler et al. | 89/45 |
| 4,481,862 | 11/1984 | Wiethoff et al. | 89/46 |
| 4,860,633 | 8/1989 | Wiethoff et al. | 89/45 |
| 4,947,728 | 8/1990 | Muhlhausen et al. | 89/46 |

FOREIGN PATENT DOCUMENTS

| | | | |
|---|---|---|---|
| 3725762 | 2/1989 | Fed. Rep. of Germany | 89/46 |

*Primary Examiner*—Deborah L. Kyle

*Assistant Examiner*—Stephen Johnson

*Attorney, Agent, or Firm*—Sprung Horn Kramer & Woods

[57] ABSTRACT

An ammunition positioner for upright ammunition shells has an arm mounted on a base, capable of being extended parallel to the plane that the shell stands on. The positioner has a pincher-like pickup with two jaws that pivots parallel to that plane. The pickup and its jaws are both controlled by a motor that is secured to the base. The motor's output wheel is coupled to the intake wheel of a transmission by way of a rotating splined shaft and a hollow shaft. The splined shaft is mounted in the base and parallel to the positioning arm. The hollow shaft is coaxial with the splined shaft and is mounted in and parallel to the positioning arm. A sleeve travels back and forth on the splined shaft and couples the hollow shaft to the splined shaft such that the former will rotate along with the latter. The transmission has two cogwheels, one of which is always coupled to the intake wheel and the other of which is coupled to and can be uncoupled from the intake wheel by a gear that can be disengaged. One cogwheel activates controls that shift the pickup jaws out of a phase wherein they maintain the shell stationary, through a phase wherein they lift the round to a prescribed level, and into a phase wherein they tighten around the shell to position it. The other cogwheel activates other controls that induce the pivoting motion of the pickup.

8 Claims, 7 Drawing Sheets

AMMUNITION POSITIONER, ESPECIALLY FOR A COMBAT VEHICLE

BACKGROUND OF THE INVENTION

The invention concerns an ammunition positioner that intercepts an upright ammunition shell, tilts it, and positions it, with an arm mounted on a base, capable of being extended parallel to the plane that the shell stands on, and having a pincher-like pickup with two jaws that pivots parallel to that plane.

Ammunition positioners of this type are employed in particular in combat vehicles, armored howitzers for example, that accommodate a magazine inside and at the center, wherein the shells are stowed upright and perpendicular to the floor. These vehicles also have an automatic shell-introduction mechanism that removes a shell from the magazine, tilts it and orients it parallel with the vehicle, and forwards it to behind the weapon, where it is elevated to the loading position and adjusted to the particular azimuth and elevation of the weapon.

A shell-introduction mechanism that involves an ammunition positioner of the aforesaid type is described for example in the prior U.S. application Ser. No. 320,015 filed Mar. 7, 1989, the disclosure of which is incorporated herein by reference. Since the arm in an ammunition positioner of this type moves in relation to the base, it is difficult to supply electricity to the mechanisms that operate the pickup and its jaws. If the motors needed to operate these components are mounted on the positioning arm, that is, they will have to be supplied with electricity through suspended cables or sealed-off annular collectors.

SUMMARY OF THE INVENTION

The object of the present invention is to avoid the transmission of electricity from the base of the positioner to the positioning arm.

This object is attained in accordance with the invention in that the pickup and its jaws are both controlled by a motor that is secured to the base, whereby the motor's output wheel is coupled to the intake wheel of a transmission by way of a rotating splined shaft and a hollow shaft, in that the splined shaft is mounted in the base and parallel to the positioning arm, the hollow shaft is coaxial with the splined shaft and is mounted in and parallel to the positioning arm, and a sleeve travels back and forth on the splined shaft and couples the hollow shaft to the splined shaft such that the former will rotate along with the latter, whereby the transmission has two cogwheels, one of which is always coupled to the intake wheel and the other of which is coupled to and can be uncoupled from the intake wheel by a gear that can be disengaged, and whereby one cogwheel activates controls that shift the pickup jaws out of a phase wherein they maintain the shell stationary, through a phase wherein they lift the round to a prescribed level, and into a phase wherein they tighten around the shell to position it and the other cogwheel activates controls that induce the pivoting motion of the pickup.

The basic concept of the invention is to move the pickup and its jaws by way of a mechanical transmission with a motor that is secured to the base and is accordingly stationary. The same motor is employed to pivot the pickup and to open and close the jaws so that they can grasp the shell. In one particularly practical embodiment of the invention, the shell is lifted to a prescribed level to disengage a locking device in the ammunition magazine before the jaws tighten around the shell in order to tilt it.

The pickup jaws are controlled in a practical way by a plunger that is activated by a transmission. The jaws are kept open by springs, and the plunger closes them just tightly enough to keep the round straight without tightening around it, allowing the shell to be lifted. The jaws close farther to tighten around the shell once it has been lifted, and the pickup can finally pivot and tilt the shell, 90° for example, and deposit it in the horizontal intake tray. Although the pivoting motion of the pickup is derived from the same mechanism, it must not affect the state of the jaws, and the shell will remain secure while it is being tilted and will not be released by the plunger until the pivoting motion is complete.

The ammunition positioner in accordance with the invention will reliably and extensively accelerate the positioning of even heavy shells.

The invention will now be described by way of example with reference to the drawings, wherein

DETAILED DESCRIPTION OF THE INVENTION

Figure 1:
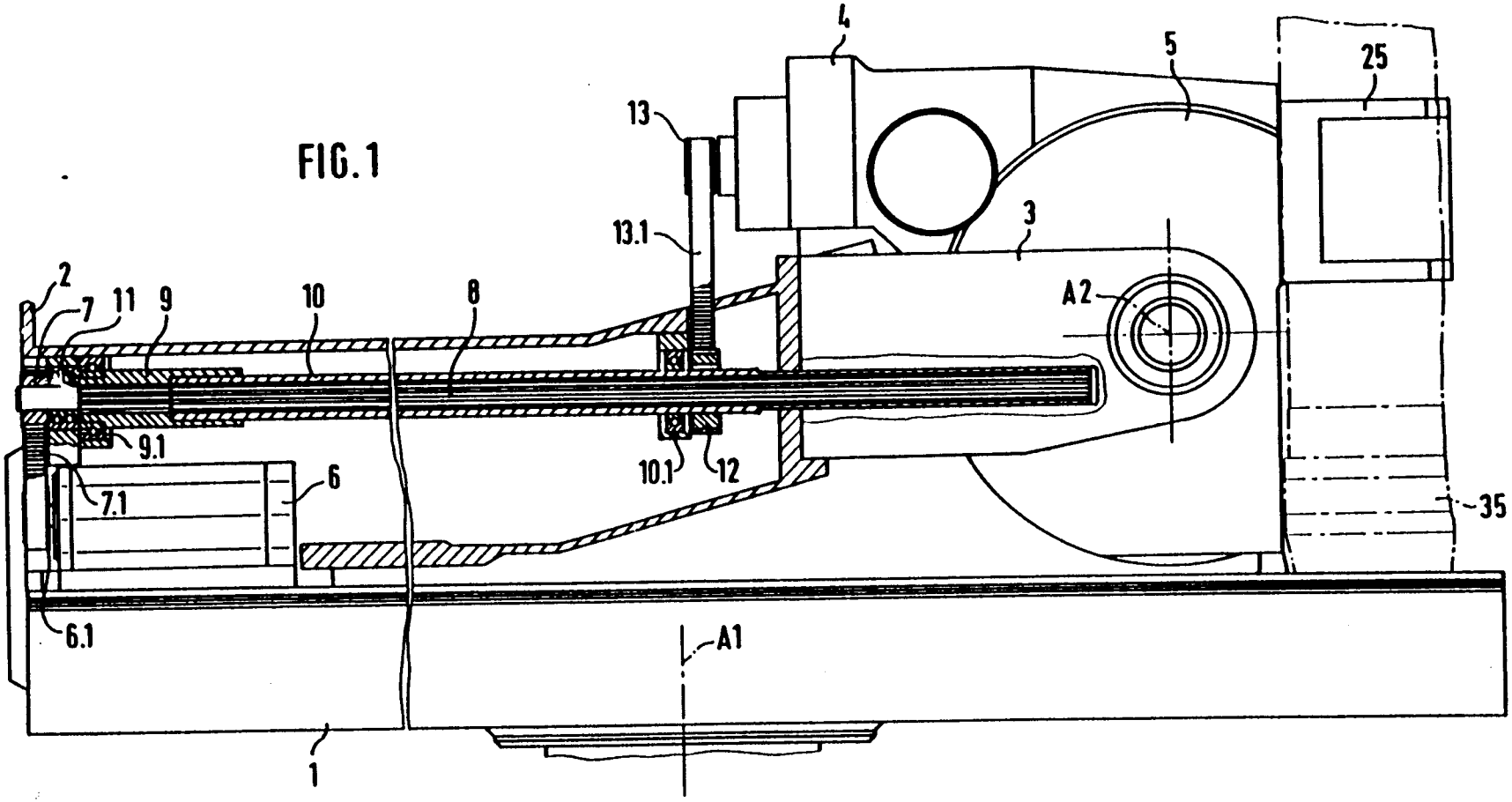
FIG. 1 is a partly sectional schematic side view of an ammunition positioner.

The ammunition positioner schematically illustrated in FIG. 1 can be mounted on the floor of an otherwise unillustrated combat vehicle. It has a base 1 that pivots on a vertical axis A1. A positioning arm 2 in the form of a carriage slides back and forth on it in a plane that is horizontal in FIG. 1. The mechanisms that move the arm back and forth are not illustrated. Mounted on the right-hand end of positioning arm 2 in FIG. 1 are a transmission 4 and an intake fork 3 for a pickup 5. Pickup 5 pivots on a horizontal axis A2 in intake fork 3 and has on the front a pincher-like grasping mechanism that will be described in greater detail hereinafter and that has two jaws positioned in a pickup fork 25 that preliminarily centers the shell 35 that is to be positioned, simultaneously ensuring a certain level of protection for the pickup kinematics.

The pickup and its jaws are both operated by an electric motor 6 secured to base 1. The output wheel 6.1 is coupled by way of a toothed belt 7.1 to a disk 7 positioned at one end of a splined shaft 8. Splined shaft 8 rests coaxially in a hollow shaft 10 mounted on a bearing 10.1 on positioning arm 2. A sleeve 9 mounted on another bearing 9.1 on positioning arm 2 couples the two shafts together such that hollow shaft 10 will slide along splined shaft 8 but rotate along with it. Mounted on hollow shaft 10 is another belt disk 12 that transmits the rotation of hollow shaft 10 to still another belt disk 13, which constitutes an intake wheel for the transmission 4 mounted on positioning arm 2.

The advantage of transmitting the torque of motor 6 to splined shaft 8 and from hollow shaft 10 to the belt disk 13 in transmission 4 by toothed belts is that any discrepancy in alignment can be compensated for by the transmission mechanisms.

Transmission 4 distributes the flow of force between two different paths as schematically illustrated for clarity's sake by the two different views in FIG. 4, wherein the components below and to the right of the heavy separating line are viewed from the side and those above the line are viewed from above. As will be evident from FIG. 4 and from the details in FIGS. 2 and 3, the transmission has two identical helical gears. One branch of the train leads from belt disk 13 and over a continuous shaft to a spur wheel 15. Spur wheel 15 engages another spur wheel 16 that in turn engages the thread 17 of one helical gear. The worm wheel 18 in this helical gear engages another spur wheel 19. Spur wheel 19 engages the teeth of a quadrant 20 that operates the pickup jaws and that will be called a pickup quadrant hereinafter.

The second branch of the force-transmission train leads from intake wheel 13 to a shifting spur wheel 27 that engages still another spur wheel 28. Spur wheel 28 is coupled to the thread 29 of another helical gear. The worm wheel 30 is coupled to another spur wheel 31 that engages the teeth in another quadrant 32. Pivoting quadrant 32 pivots pickup 5 and will accordingly be called a pivoting quadrant hereinafter.

Figure 2:
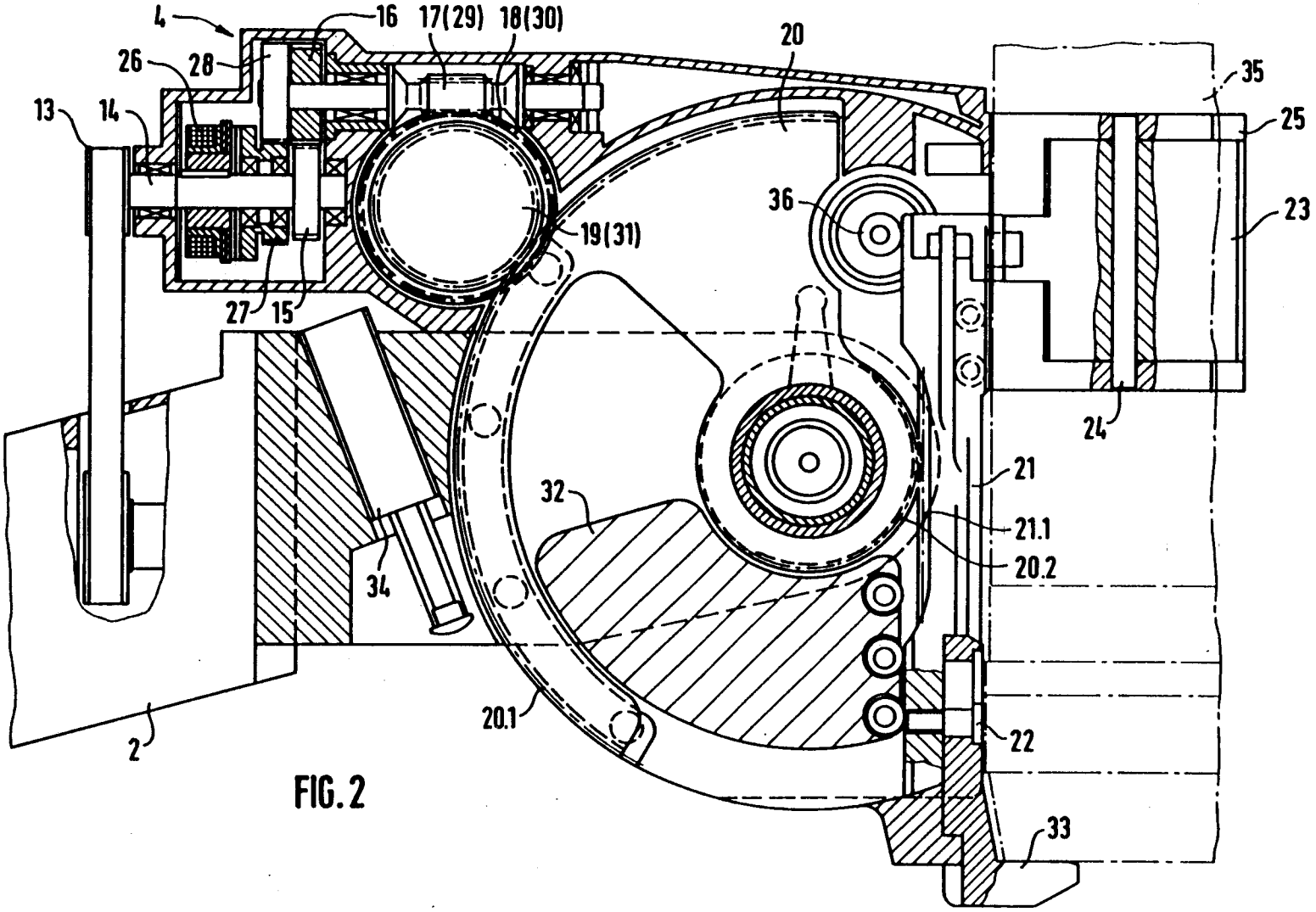
FIG. 2 is slightly magnified vertical section through the pickup of the ammunition positioner illustrated in FIG. 1.
Figure 3:
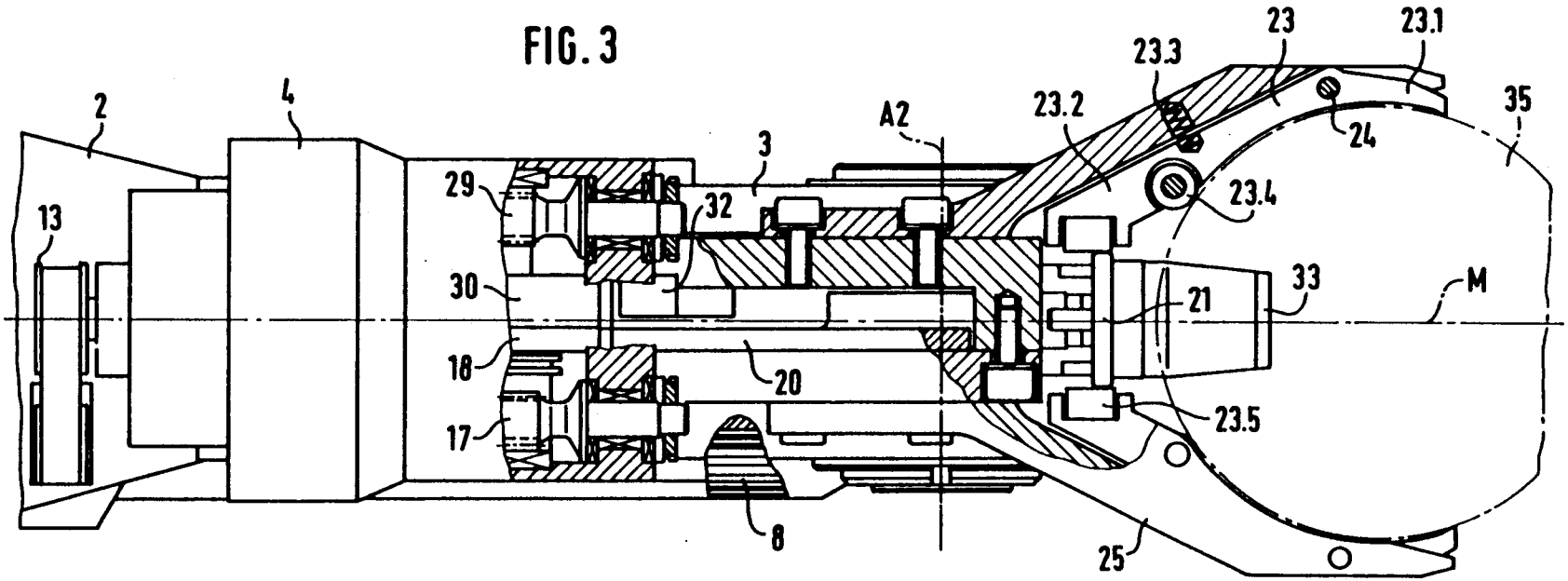
FIG. 3 is a partly sectional top view of the pickup illustrated in FIG. 2.

Pickup quadrant 20 and pivoting quadrant 32 are positioned in vertical planes that are mutually parallel and symmetrical to the midplane M of the pickup. Some of the components of the helical gear illustrated in FIG. 2 are directly behind others as represented by the figures in parentheses. Pickup quadrant 20 and pivoting quadrant 32 pivot around the same horizontal axis A2. Since both helical gears have the same transmission ratio and since both quadrants are identical, the two quadrants will pivot in synchronization with no relative motion between them when an electromagnetic coupling 26 is engaged.

When electromagnetic coupling 26 is not engaged, on the other hand, only pickup quadrant 20 will pivot.

Figure 4:
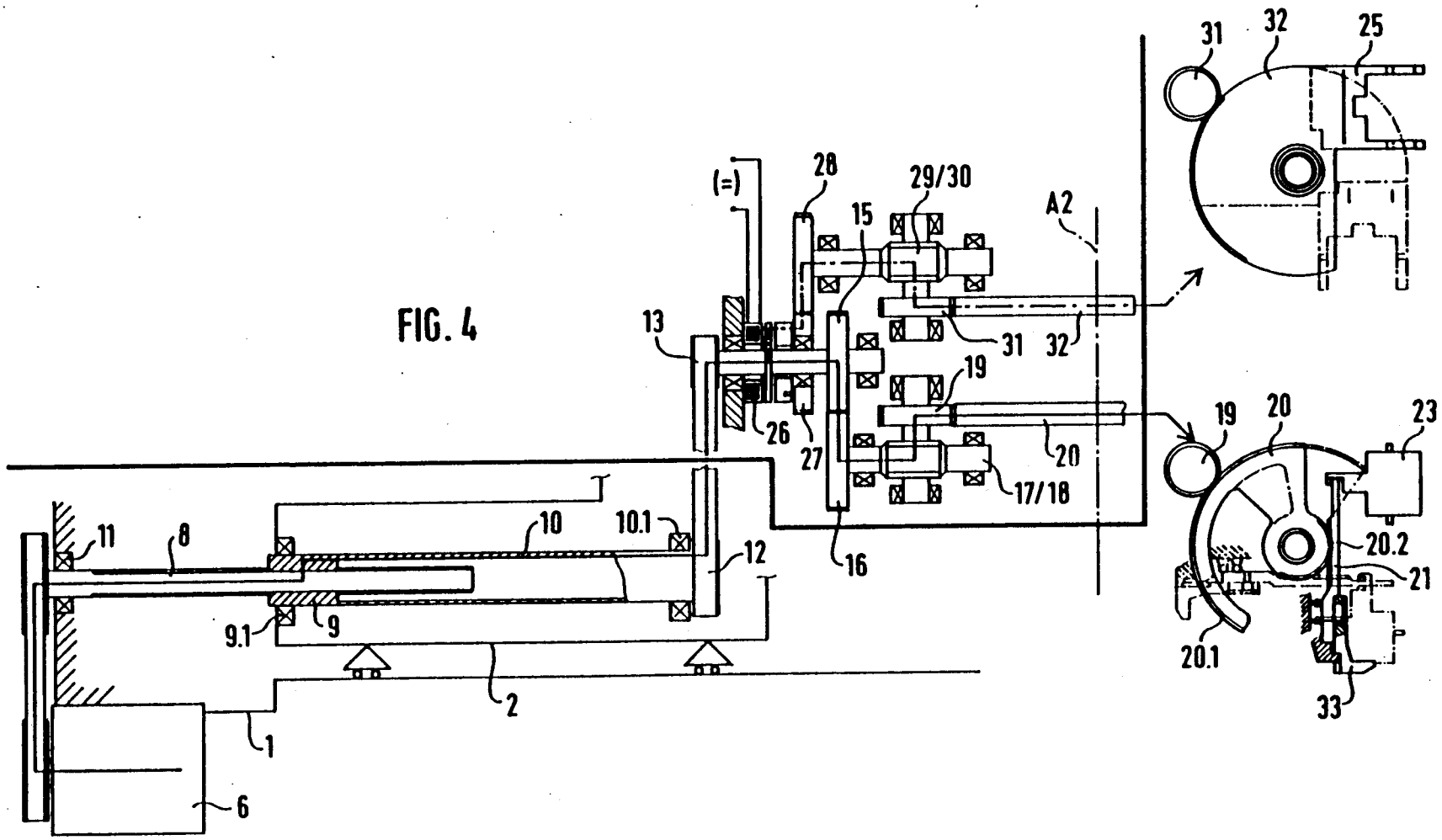
FIG. 4 is a highly schematic partly side view and partly top view illustrating the transmission of motion from the motor to the pickup of the ammunition positioner illustrated in FIGS. 1 through 3, FIGS. 5*a* through 5*d* illustrate part of the plunger that activates the pickup jaws in the ammunition positioner illustrated in FIGS. 1 through 4 in various phases.
Figure 5B:
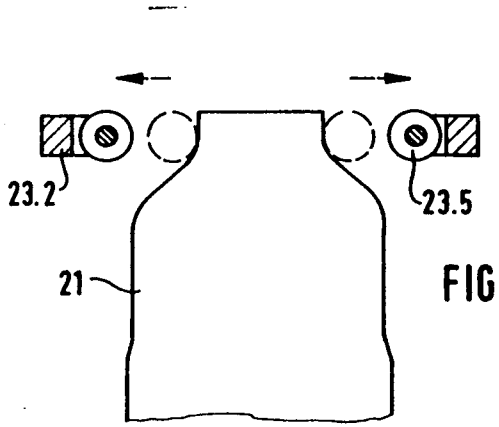

As will be evident from FIGS. 2 and 4, pickup quadrant 20 activates a control plunger 21. Pickup quadrant 20 has for this purpose two arcs of teeth, specifically teeth 20.1, which mesh with the spur wheel 19 in the transmission, and teeth 20.2, which mesh with the teeth on a rack 21.1 that extends along plunger 21. Plunger 21 is positioned in pickup 5 in a direction that is vertical in FIGS. 1, 2, and 4 and parallels the length of an upright shell that is being picked up. Plunger 21 will pivot along with pickup fork 25 as described hereinafter as the shell is tilted. How plunger 21 activates the pickup will be evident from FIGS. 5*a* to 5*c*, 6*a* and 6*b*, and 7*a* and 7*b*.

The two jaws 23 in pickup fork 25 constitute a double-armed lever that pivots on an axis 24 with a pickup arm 23.1 at the front and a control arm 23.2 a the rear. They rest on compression springs 23.3 against pickup fork 25 and keep pickup arms 23.1 open. Inside control arms 23.2 are contact rollers 23.4. When pickup fork 25 is positioned around a shell 35, it will rest against contact rollers 23.4, and pickup arms 23.1 will, due to the lever action, come to rest against the outer surface of shell 35 against the force of springs 23.3.

Figure 5A:
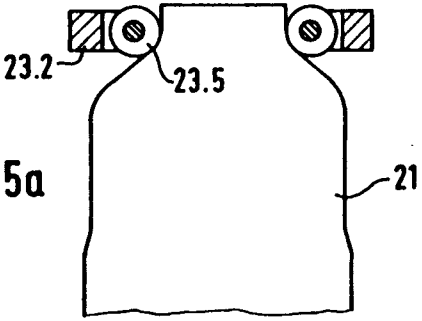

Plunger 2 is introduced between the two ends of control arms 23.2 in such a way that contact rollers 23.5 on the outer ends of the arms will roll over the surface of the plunger. How jaws 23 participate in picking up a shell will be evident from FIGS. 5*a* through 7*b*. FIGS. 5*a* and 6*a* illustrate the phase wherein jaws 23, which are kept open by the springs, are closed by the surface of the shell as the pickup is introduced in a straight line. Plunger 21 initially remains in the starting position illustrated in FIGS. 5*a* and 5*b*.

Figure 6B:
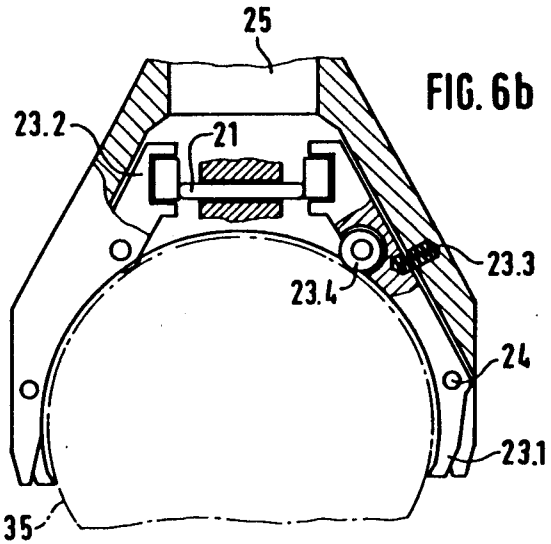
FIGS. 6*a* and 6*b* are top views of the pickup jaws illustrating the plunger in the phases illustrated in FIGS. 5*a* and 5*b*, FIGS. 7*a* and 7*b* illustrate the pickup jaws, plunger, and a quadrant with the plunger in the phases illustrated in FIGS. 5*c* and 5*d*.
Figure 6A:
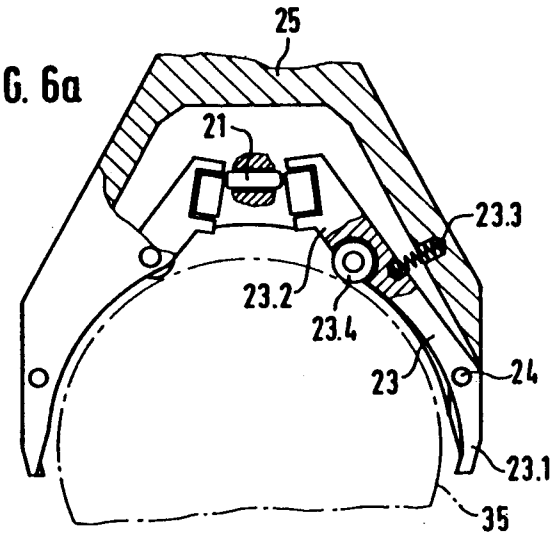

FIG. 6*b* illustrates the position of jaws 23 once shell 35 has been advanced.

Figure 5D:
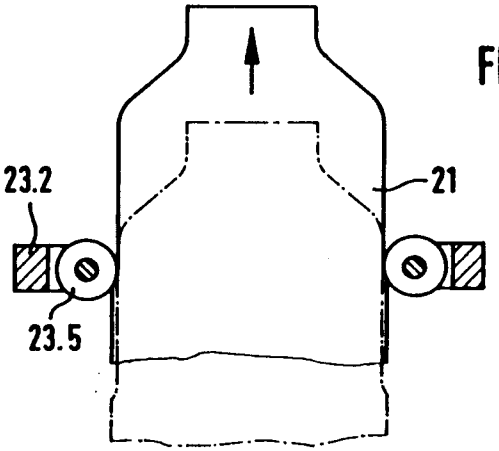
Figure 5C:
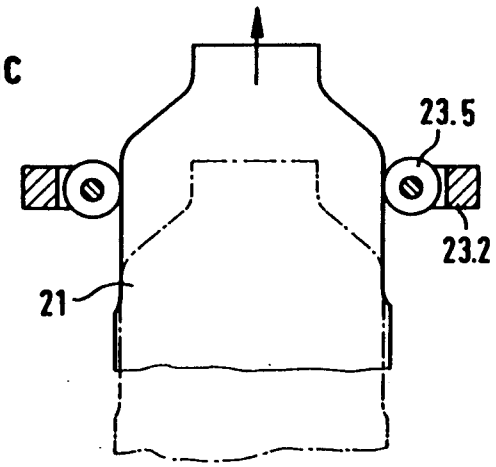
Figure 7B:
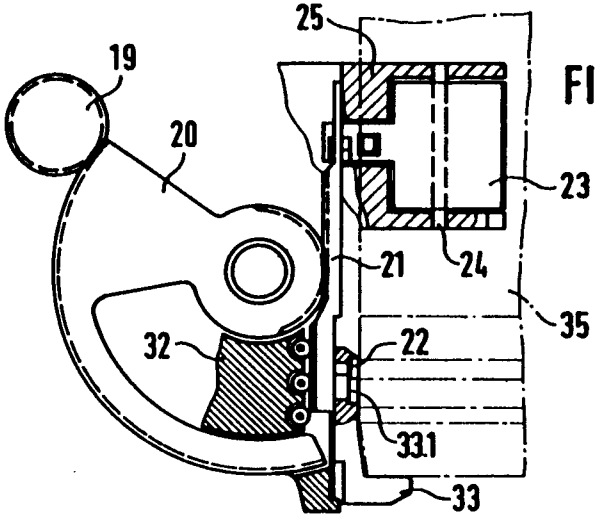
Figure 7A:
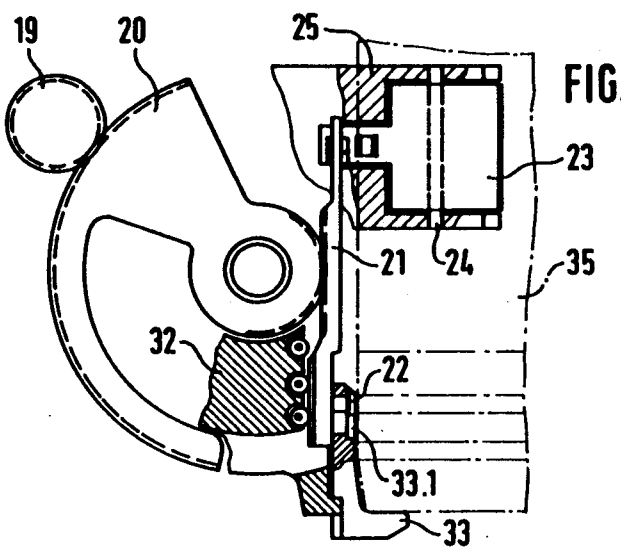

As will be evident from FIG. 5*c*, the plunger will now travel up as pickup quadrant 20 is activated by motor 6 as previously described herein with electromagnetic coupling 26 disengaged. The positioning rollers 23.5 in jaws 23 simultaneously arrive at a curve on plunger 21 where they are blocked, securing shell 35 radially and preventing it from falling over and out while it is subsequently being lifted axially. Pickup quadrant 20 will by the end of this phase have pivoted approximately 24° (cf. FIG. 7*a*) and plunger 21 will have traveled approximately 20 mm.

A pickup shoe 33 is positioned at the bottom of plunger 21 and engages the bottom of shell 35 as the shell is advanced. The shell is at this point still inside the magazine and in a bolted holder that must be unbolted by lifting the shell and that is not illustrated in detail. Shell 35 is lifted approximately 26 mm as plunger 21 continues to rise, and a carrier 22 on plunger 21 that fits into a groove 33.1 in pickup shoe 33 establishes contact between plunger 21 and pickup shoe 33 and lifts it as well. Since jaws 23 surround shell 35 but have not yet tightened around it, it will be advanced through the distance lifted into the position represented in FIG. 5*d* or 7*b*, wherein positioning rollers 23.5 advance along a slope in the contour of plunger 21 that tightens jaws 23 around shell 35. At this phase, at which the pickup segment will have pivoted approximately 55°, the shell can be removed from the magazine by appropriately displacing the positioning arm. Once base 1 has rotated around vertical axis A1, the overall pickup 5 can pivot down and forward.

The moment needed to pivot the pickup down can be initiated by engaging electromagnetic coupling 26, coupling pivoting quadrant 32 to motor 6 by way of another output wheel 31 in transmission 4. Output wheels 19 and 31 are now both coupled to motor 6. Since both wheel rotate at the same speed, no difference between the motions of pickup quadrant 20 and pivoting quadrant 32 is allowed. Pickup 5, which is rigidly secured to pivoting quadrant 32, is pivoted down along with jaws 23, plunger 21, and shell 35, with the entrainment of pickup quadrant 20 ensuring that shell 35 will be tightly secured during the pivoting motion.

Shell 35 is released with the pickup down by disengaging electromagnetic coupling 26 and reversing the direction of motor 6, whereby pickup quadrant 20 returns plunger 21 to the initial position illustrated in FIG. 5*a*. Once shell 35 has been deposited in an unillustrated intake tray and electromagnetic coupling 26 has been engaged again, pickup is pivoted back ready to pick up the next shell.

Figure 8:
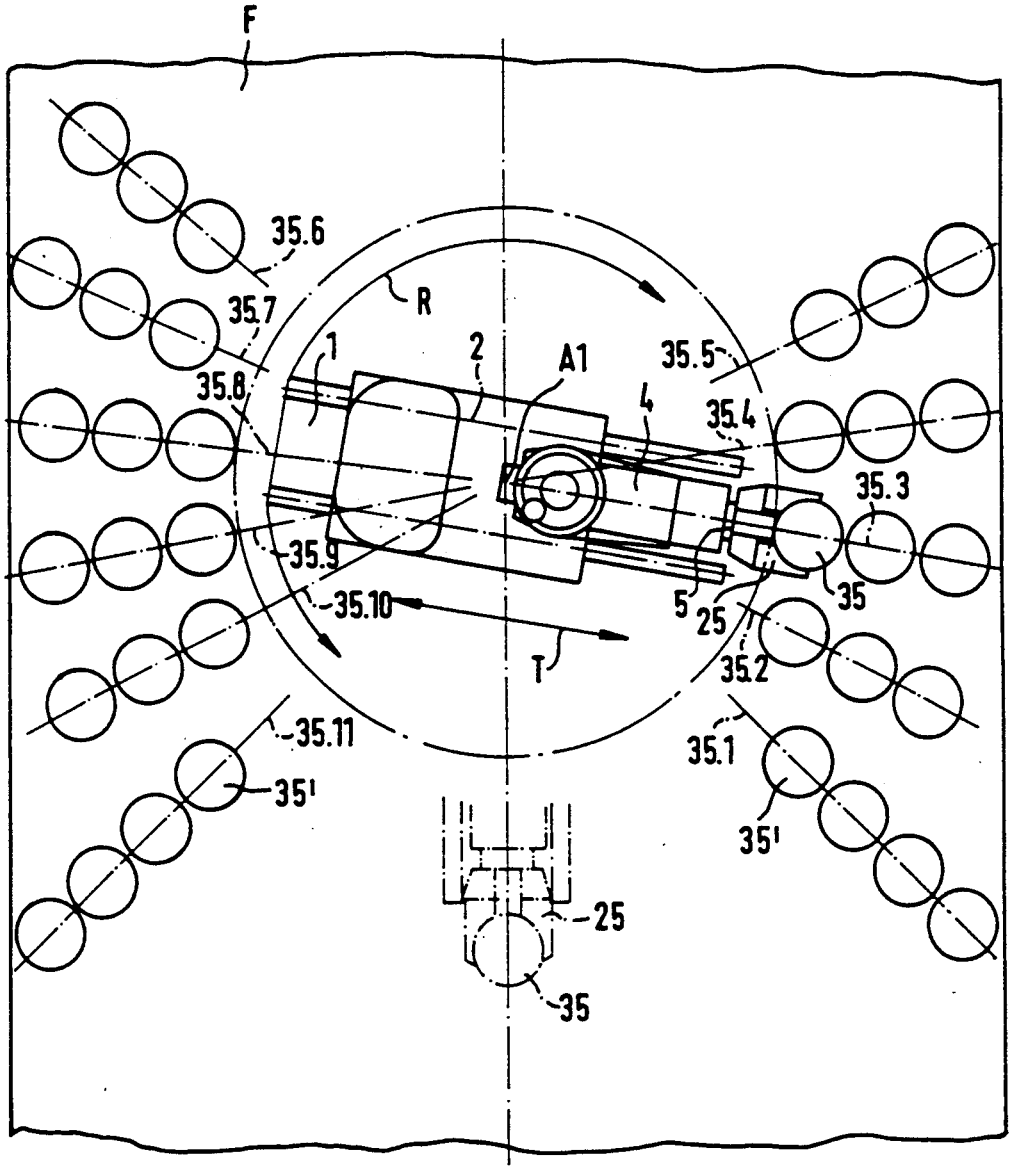
FIG. 8 is a highly schematic top view of the ammunition positioner illustrated in FIG. 1 on the floor of a combat vehicle and with the shells stowed upright in it.

FIG. 8 illustrates how the ammunition positioner described herein can be accommodated inside a combat vehicle. Note that FIG. 8 illustrates only the most important components of the ammunition positioner and in a highly schematic form. These components comprise base 1, which pivots back and forth around vertical axis A1 in the directions indicated by double-headed arrow R and the positioning arm 2 in the form of a carriage that slides back and forth on the base in conjunction with transmission 4 and the pickup 5 that pickup fork 25 is mounted on. Shells 35' stand upright in several rows on the floor F of the vehicle. FIG. 8 illustrates a total of eleven rows 35.1 to 35.11, each accommodating three or four shells 35'. The shells can be stowed in magazines, which are for simplicity's sake not illustrated. Since the axes of rows 35.1 to 35.11 radiate, as will be evident from FIG. 8, from axis A1 of rotation, grasping fork 25 can be oriented toward any row by rotating base 1 as indicated by double-headed arrow R and displacing positioning arm 2 as indicated by double-headed arrow T. FIG. 8 illustrates the ammunition positioner at the instant grasping fork 25 is applied to the first shell 35 in row 35.3. Once shell 35 has been picked up, positioning arm 2 can be pivoted back clockwise into the position represented by the broken lines in FIG. 8. In this position, shell 35 can be released by pickup 5 o grasping fork 25. It can either be deposited or, as described in prior U.S. patent application Ser. No. 320 015, be readied for further handling.

What is claimed is:

1. An ammunition positioner for upright ammunition shells, comprising: a base, an arm, means mounting the arm on the base for movement perpendicular to a longitudinal axis of the shell, wherein, the arm comprises a pincher-like pickup with two jaws pivotable perpendicular to said longitudinal axis and means for pivoting the pickup and the jaws comprising a motor secured to the base, an output wheel rotatable by the motor, a transmission having an intake wheel and means coupling the intake wheel to the output wheel comprising a rotating splined shaft and a hollow shaft, wherein the splined shaft is mounted on the base and parallel to the positioning arm, the hollow shaft is coaxial with the splined shaft and is mounted in and parallel to the arm, a sleeve slidable back and forth on the splined shaft and coupling the hollow shaft to the splined shaft for rotation therewith, two cogwheels including one cogwheel always coupled to the intake wheel and means for coupling and uncoupling the other cogwheel to the intake wheel comprising a disengageable gear, first controls responsive to said one cogwheel to shift the pickup jaws out of a phase wherein the shell is maintained stationary, through an intermediate phase wherein the shell is lifted to a prescribed level, and into a phase wherein the jaws tighten around the shell to position it and second controls responsive to the other cogwheel to effect the pivoting motion of the pickup.

2. The ammunition positioner as in claim 1, wherein the first controls have a pickup quadrant that pivots around an axis perpendicular to the longitudinal axis of the shell and across a longitudinal axis of the positioning arm, with an arc of teeth that engage the one cogwheel and with another arc of teeth than engage a rack mounted longitudinally on a plunger, and the two jaws, are kept open by a spring, and comprise a double-armed lever, each having a pickup arm and a control arm, and the plunger is positioned between the two control arms, and the plunger is configured such that, although the shell is not secured tightly during said first phase by the jaws, it will not fall over and out, whereas in the second phase it will be secured tightly between the jaws.

3. The ammunition positioner as in claim 2, wherein the plunger, which is parallel to the longitudinal axis of the shell picked up by the jaws, has a carrier that in the intermediate phase lifts to a prescribed elevation a shoe that can be displaced along the shell and than engages a base of the shell when the jaws are applied to the shell.

4. The ammunition positioner as in claim 2, wherein the second controls have a quadrant that pivots around the same axis as the first quadrant, has the pickup mounted on it, and has an arc of teeth that engage the other cogwheel, wherein ratios between the transmission and the two cogwheels and between the two cogwheels and the two arcs of teeth are equal.

5. The ammunition positioner as in claim 1 wherein the means for coupling and uncoupling comprises an electromagnetic coupling.

6. The ammunition positioner as in claim 1, wherein the means coupling the intake wheel and the two cogwheels, comprises two helical transmissions.

7. The ammunition positioner as in claim 1, further comprising a toothed belt coupling the hollow shaft to the input wheel.

8. The ammunition positioner as in claim 1, further comprising a toothed belt coupling the motor to the splined shaft.

* * * * *